US012781982B2

(12) United States Patent
Ozawa

(10) Patent No.: US 12,781,982 B2
(45) Date of Patent: Nov. 3, 2026

(54) STERILIZATION UNIT

(71) Applicant: Carrier Japan Corporation, Tokyo (JP)

(72) Inventor: Tetsuro Ozawa, Shizuoka (JP)

(73) Assignee: Carrier Japan Corporation, Tokyo (JP)

( * ) Notice: Subject to any disclaimer, the term of this patent is extended or adjusted under 35 U.S.C. 154(b) by 221 days.

(21) Appl. No.: 18/729,341

(22) PCT Filed: Jan. 11, 2023

(86) PCT No.: PCT/JP2023/000443
§ 371 (c)(1),
(2) Date: Jul. 16, 2024

(87) PCT Pub. No.: WO2023/140153
PCT Pub. Date: Jul. 27, 2023

(65) Prior Publication Data
US 2025/0093055 A1 Mar. 20, 2025

(30) Foreign Application Priority Data
Jan. 19, 2022 (JP) ..... 2022-006791

(51) Int. Cl.
*F24F 8/22* (2021.01)
*F24F 13/20* (2006.01)

(52) U.S. Cl.
CPC ..... *F24F 8/22* (2021.01); *F24F 13/20* (2013.01); *F24F 2013/207* (2013.01); *F24F 2221/14* (2013.01)

(58) Field of Classification Search
CPC . A61L 2/10; A61L 2/101; A61L 2/102; A61L 2/104; A61L 2/108; A61L 2/24;
(Continued)

(56) References Cited

U.S. PATENT DOCUMENTS

2002/0031460 A1* 3/2002 Kulp ..... F24F 8/22 422/292
2017/0321877 A1* 11/2017 Polidoro ..... F24F 13/28
2020/0289698 A1 9/2020 Polidoro

FOREIGN PATENT DOCUMENTS

JP S5220059 U 2/1977
JP S6181522 U 5/1986
(Continued)

OTHER PUBLICATIONS

International Search Report and Written Opinion for International Application No. PCT/JP2023/000443, mailed Mar. 20, 2023, 17 pages.
(Continued)

*Primary Examiner* — Timothy C Cleveland
(74) *Attorney, Agent, or Firm* — DLA PIPER LLP (US)

(57) ABSTRACT

To Provide a sterilization unit (11) that can safely perform the work of inspecting or replacing an ultraviolet lamp (32). A sterilization unit (11) is provided with: a casing (12), an ultraviolet lamp (32) sterilizing air passing through the casing (12); a control board (65*a*) for the ultraviolet lamp (32), and an electrical component box (61) provided on one side surface of the casing (12) to house the control board (65*a*). The electrical component box (61) is provided with a base part (62) fixed to the casing (12), a first lid part (63) and a second lid part (64) that are swingably coupled to the base part (62), and a microswitch (72) that detects that the second lid part (64) is not in a predetermined position. The control board (65*a*) is mounted on the first lid part (63).

2 Claims, 12 Drawing Sheets

(58) Field of Classification Search
CPC ..... A61L 9/18; A61L 9/20; F24F 8/22; F24F 13/20; F24F 2013/207; F24F 221/14
See application file for complete search history.

(56) References Cited

FOREIGN PATENT DOCUMENTS

| | | | |
|---|---|---|---|
| JP | H11173587 | A | 6/1999 |
| JP | H11263322 | A | 9/1999 |
| JP | 2011075117 | A | 4/2011 |
| JP | 2022042589 | A | 3/2022 |
| JP | 2022149694 | A | 10/2022 |
| WO | 2009119524 | A1 | 10/2009 |

OTHER PUBLICATIONS

"Virus Eliminator," Doryoku co., ltd., Mar. 23, 2021 [Retrieved on Mar. 8, 2023], 5 pages, Retrieved from the internet: https://www.doryolcu.co.jp/pdf/virus_eliminator.pdf.
Action for Korean Patent Application No. 10-2024-7022116, mailed Jun. 10, 2026, 11 Pages.

* cited by examiner

STERILIZATION UNIT

CROSS REFERENCE TO RELATED APPLICATIONS

This application is a U.S. National Stage Application of International Application No. PCT/JP2023/000443 filed Jan. 11, 2023, which claims priority from Japanese Patent Application No. 2022-006791 filed Jan. 19, 2022. The entirety of all the above-listed applications are incorporated herein by reference.

TECHNICAL FIELD

An embodiment of the present invention relates to a sterilization unit.

BACKGROUND ART

The impact of novel coronavirus (COVID-19) infections has increased the need for improved air quality environments as a measure to prevent infection.

For example, Patent Document 1 discloses an air conditioning system including an ultraviolet lamp in an indoor unit or in an air circulation passage of the air conditioning system to eliminate germs contained in the air.

PRIOR ART DOCUMENTS

Patent Document

Patent Document 1: JP 2022-042589 A

SUMMARY OF THE INVENTION

Problems to be Solved by the Invention

Ultraviolet light is categorized into UV-A, UV-B, and UV-C. Among these categories, UV-C is said to have a significant effect on germs. On the other hand, UV-C may have adverse effects on the human body when the human body is directly exposed to UV-C. During inspection or replacement of ultraviolet lamps that generate UV-C, it is necessary to ensure that the ultraviolet lamps that generate UV-C are turned off.

An object of the present invention is to provide a sterilization unit that allows inspecting work or replacing work of the ultraviolet lamps to be performed safely.

Means for Solving Problem

To achieve the above object, an aspect of the present invention provides a sterilization unit including: a casing, an ultraviolet lamp sterilizing air passing through the casing, a control board for the ultraviolet lamp, and an electric component box provided on one side surface of the casing to house the control board. The electric component box includes a base part fixed to the casing, a first lid part that is swingably coupled to the base part, a second lid part that is swingably coupled to the base part, and a detector that detects that the second lid part not in a prescribed position, and the control board is attached to the first lid part.

It may be desired that the casing includes a maintenance panel that is opened and closed when the ultraviolet lamp is inspected or replaced, and the maintenance panel has a detection target to be detected by the detector.

Effects of Invention

The present invention can provide a sterilization unit that allows inspecting work or replacing work of the ultraviolet lamps to be performed safely.

DESCRIPTION OF EMBODIMENTS

Figure 1:
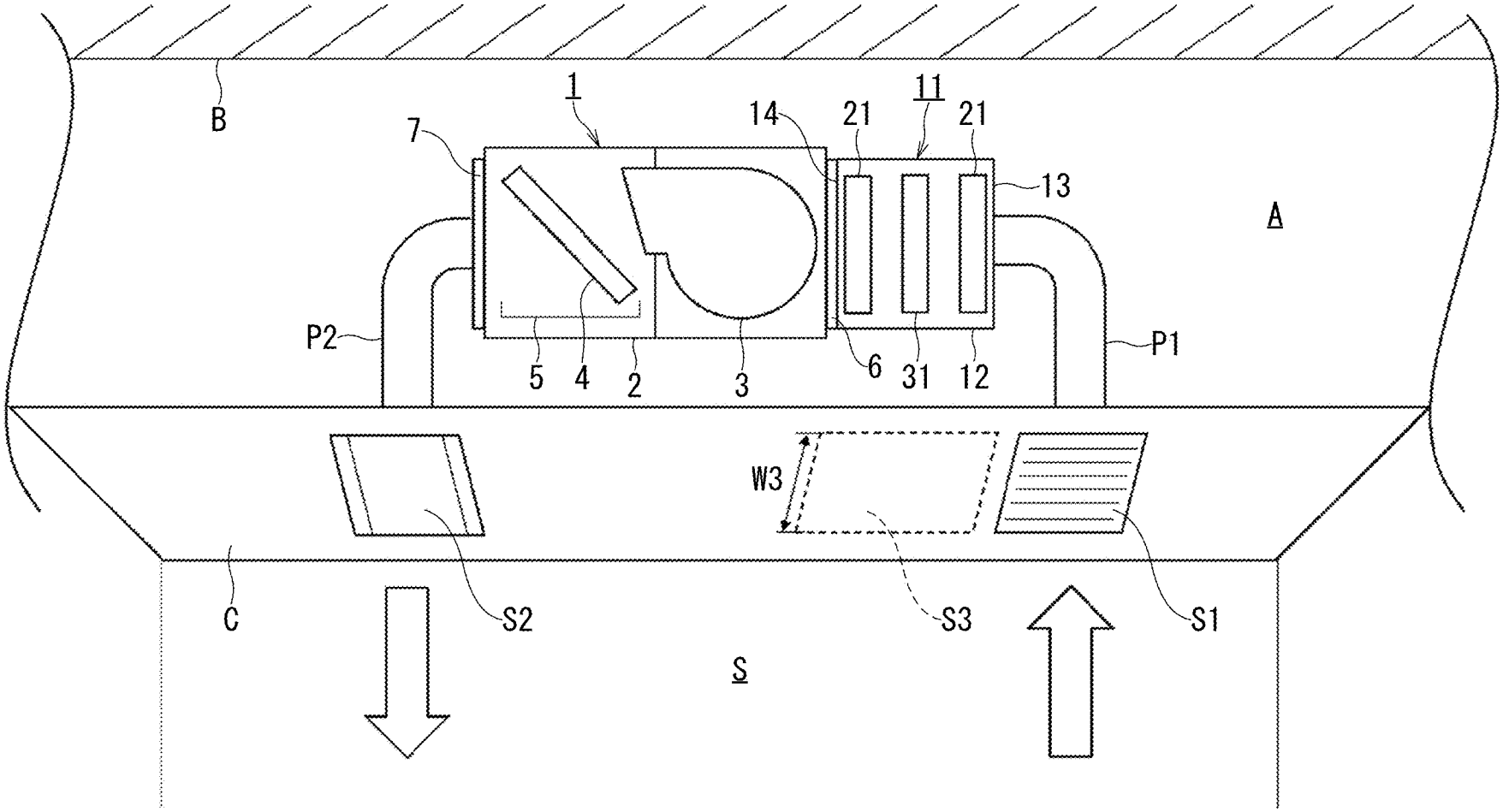
FIG. 1 is a side view schematically showing an indoor unit and a sterilization unit of an air conditioner of an embodiment being installed above a ceiling.

An embodiment of a sterilization unit according to the present invention is described with reference to FIGS. 1 to 12. In the drawings, identical or corresponding component members are designated by identical reference signs.

FIG. 1 is a side view schematically showing an indoor unit and the sterilization unit of an air conditioner installed above a ceiling.

As shown in FIG. 1, the indoor unit 1 of the air conditioner (hereinafter simply referred to as "air conditioning indoor unit 1") and a sterilization unit 11 are installed, for example, above a ceiling of a building. In the present embodiment, the term "above a ceiling" refers to a ceiling space A defined between a beam B and a ceiling panel C of the building.

The air conditioning indoor unit 1 is a duct-type air conditioning indoor unit for a ceiling-embedded air conditioner. The air conditioning indoor unit 1 includes a casing 2, a blower 3, a heat exchanger 4, and a drain pan 5. The blower 3, the heat exchanger 4, and the drain pan 5 are provided inside the casing 2. The casing 2 includes a suction port 6 and a blowout port 7.

The sterilization unit 11 according to the present embodiment, which is connected to the indoor unit of the ceiling-embedded air conditioner, emits ultraviolet light (UV-C) from an ultraviolet lamp 32 to eliminate germs contained in the air in the building. The sterilization unit 11 is coupled to the suction port 6 of the air conditioning indoor unit 1. The sterilization unit 11 includes a casing 12, and at least one ultraviolet lamp unit 31 provided inside the casing 12. The casing 12 includes the suction port 13 and the blowout port 14.

The ceiling panel C has an indoor air suction port S1 that draws in indoor air that is the air in an air conditioning target space S, an air-conditioned air blowout port S2 that blows out air-conditioned air, passing through the sterilization unit 11 and the air conditioning indoor unit 1, to the air conditioning target space S, and a maintenance hatch S3. The indoor air suction port S1 and the suction port 13 of the sterilization unit 11 are connected through a suction duct P1, and the air-conditioned air blowout port S2 and the blowout port 7 of the air conditioning indoor unit 1 are connected through a blowout duct P2.

Indoor air is drawn through the indoor air suction port S1 and flows into the sterilization unit 11 via the suction duct P1 by rotating driven the blower 3. The indoor air flowing into the sterilization unit is sterilized by the ultraviolet lamp unit 31. The sterilized indoor air flows from the sterilization unit 11 into the air conditioning indoor unit 1 and exchanges heat with a refrigerant flowing inside the heat exchanger 4. The indoor air heat-exchanged in the heat exchanger 4 is blown out as cold or warm air from the air-conditioned air blowout port S2 to the air conditioning target space S through the blowout duct P2.

Figure 2:
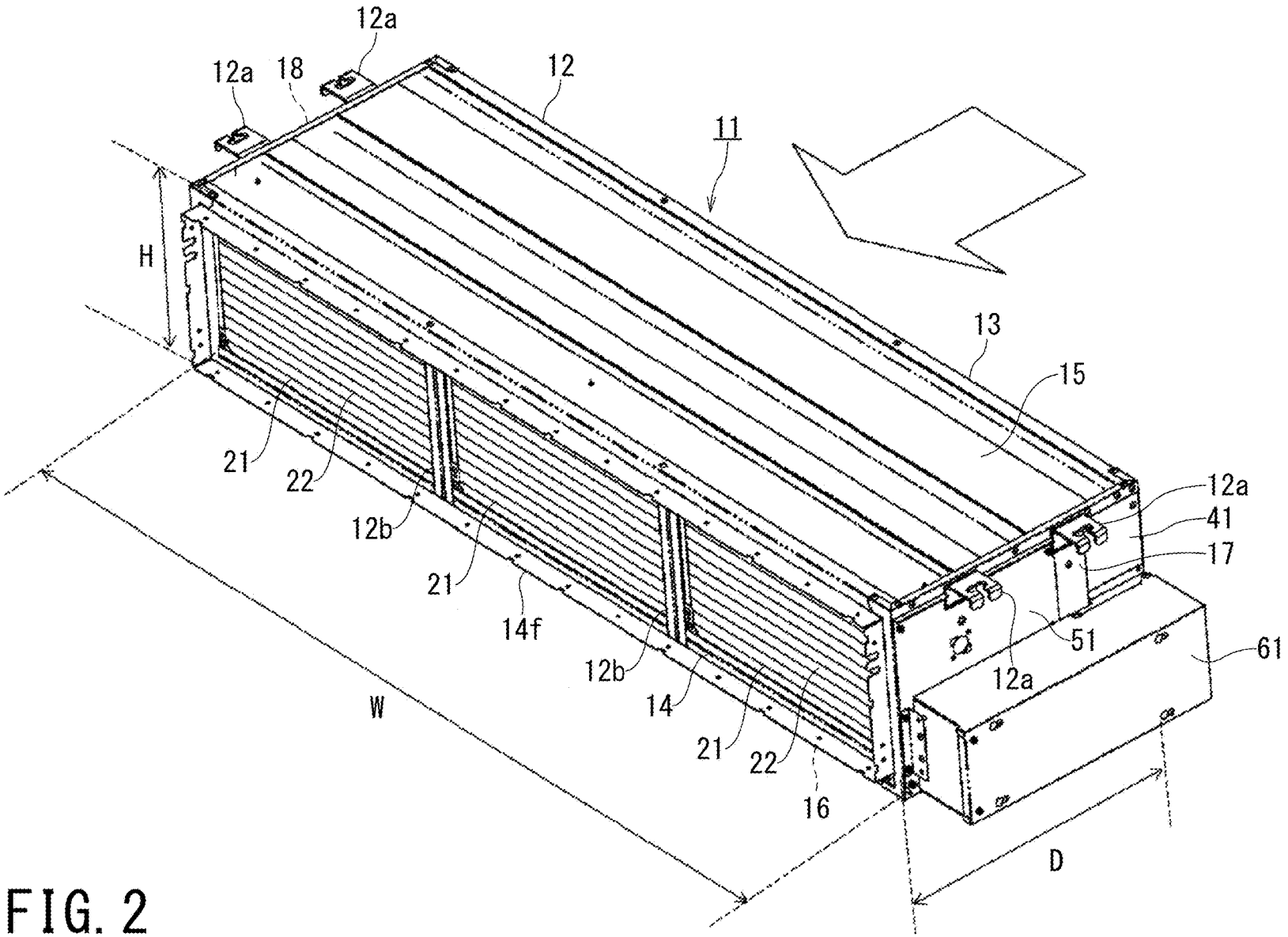
FIG. 2 is a perspective view of the sterilization unit according to the embodiment.

The sterilization unit 11 is described with reference to FIGS. 2 to 4. FIG. 2 is a perspective view of the sterilization unit, FIG. 3 is a plan view of the sterilization unit as viewed from the blowout port side, and FIG. 4 is a sectional view of the sterilization unit taken along an X-X line in FIG. 3.

Figure 3:
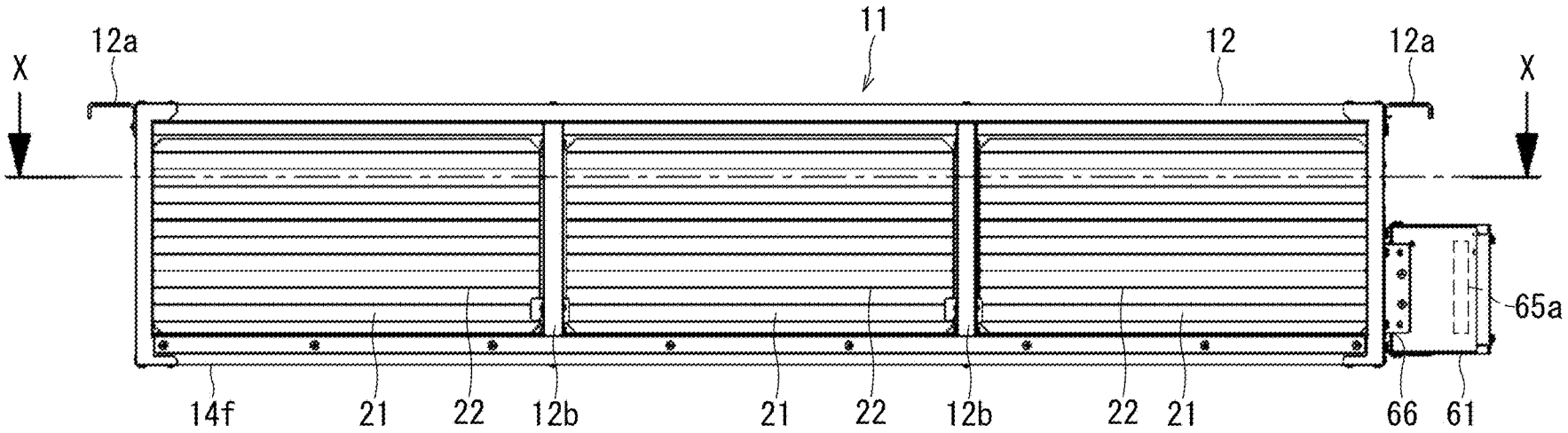
FIG. 3 is a plan view of the sterilization unit according to the embodiment as viewed from the side of a blowout port of the sterilization unit.
Figure 4:
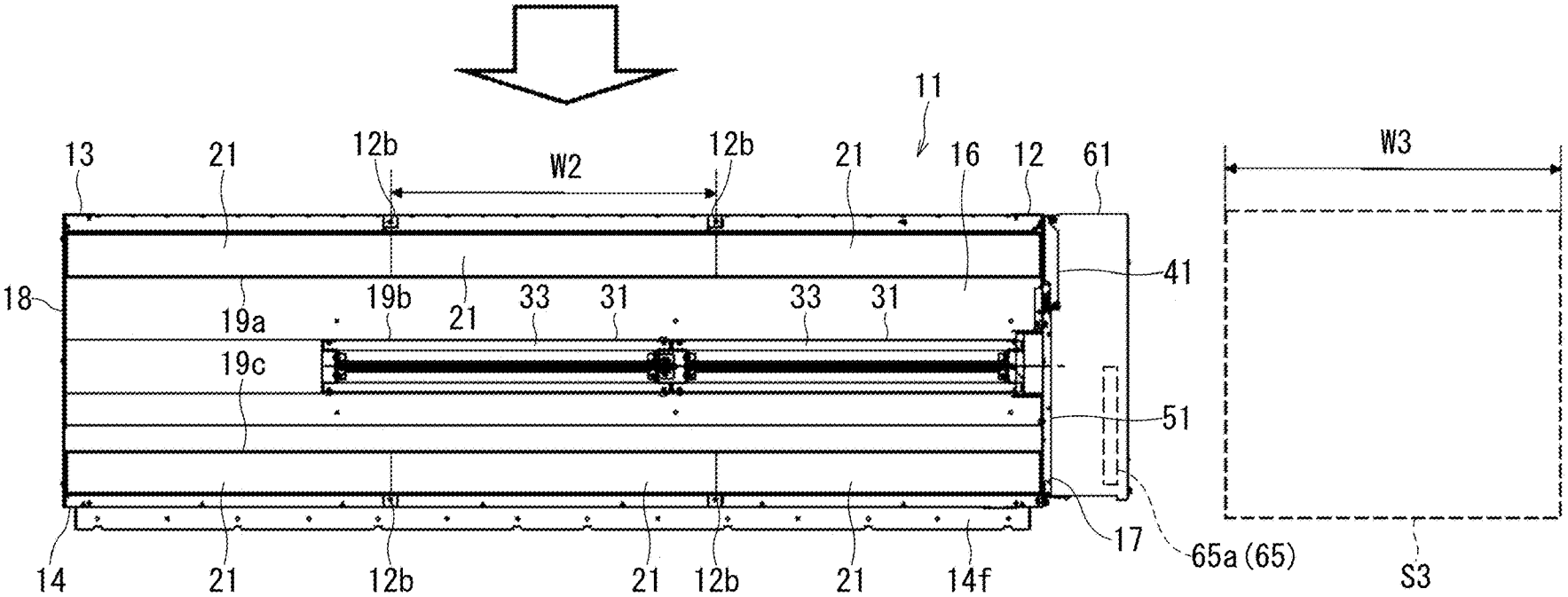
FIG. 4 is a sectional view of the sterilization unit in FIG. 3 along an X-X line.

As shown in FIGS. 2 to 4, the sterilization unit 11 according to the present embodiment includes the casing 12, and an electric component box 61 that houses an electric component 65 including a control board 65*a* of the ultraviolet lamp unit 31.

The casing 12 of the sterilization unit 11 has the shape of a flat square box, with a depth dimension D, a width dimension W, and a thickness dimension H. The depth dimension D of the casing 12 is smaller than the width dimension W of the casing 12. The thickness dimension H of the casing 12 is smaller than the depth dimension D and the width dimension W of the casing 12.

The casing 12 is a box body made of a metal plate, such as a sheet metal, for example. The casing 12 includes, as main elements, a top plate 15, a bottom plate 16, a first side plate 17, and a second side plate 18.

The top plate 15 and the bottom plate 16 extend horizontally. The top plate 15 and the bottom plate 16 face each other at a distance in the thickness direction of the casing 12. The first side plate 17 and the second side plate 18 stand so as to straddle over the top plate 15 and the bottom plate 16. The first side plate 17 and the second side plate 18 face each other at a distance in the width direction of the casing 12.

The casing 12 includes a plurality of hanging metal fittings 12*a* provided at each of an upper portion of the first side plate 17 and an upper portion of the second side plate 18. The hanging metal fittings 12*a* are coupled to hanging bolts (not shown) extending from the beam B of the building shown in FIG. 1 so that the sterilization unit 11 is hung in the ceiling space A.

A pair of side surfaces facing each other in the depth direction of the casing 12 is widely opened in the width direction of the casing 12. One opening portion serves as the suction port 13, while the other opening portion serves as the blowout port 14. The suction port 13 is connected to the suction duct P1, and the blowout port 14 is connected to the suction port 6 of the air conditioning indoor unit 1 via a connection flange 14*f*.

The casing 12 houses at least one shading grille 21 facing the suction port 13, at least one shading grille 21 facing the blowout port 14, and the ultraviolet lamp unit 31 disposed between the shading grille 21 facing the suction port 13 and the shading grille 21 facing the blowout port 14. In the present embodiment, the distance between the shading grille 21 facing the suction port 13 and the shading grille 21 facing the blowout port 14 is set to 200 millimeters (mm) or more, and more specifically about 300 millimeters (mm). The distance between the shading grills 21 ensures a sufficient space for sterilization.

In the present embodiment, the sterilization unit 11 includes three shading grilles 21 facing the suction port 13 and three shading grilles 21 facing the blowout port 14. The three shading grilles 21 facing the suction port 13 are aligned in the width direction of the casing 12. The three shading grilles 21 facing the blowout port 14 are aligned in the width direction of the casing 12. Here, the number of the shading grills 21 aligned in the width direction of the casing 12 is not limited to three, and can be increased or decreased according to the size of the casing 12 and the width dimension of the shading grills 21.

In the present embodiment, the sterilization unit 11 includes two ultraviolet lamp units 31 aligned in the width direction of the casing 12. Here, the number of the ultraviolet lamp units 31 aligned in the width direction of the casing 12 is not limited to two, and can be increased or decreased according to the size of the casing 12 and the width dimension of the ultraviolet lamp units 31.

Figure 5:
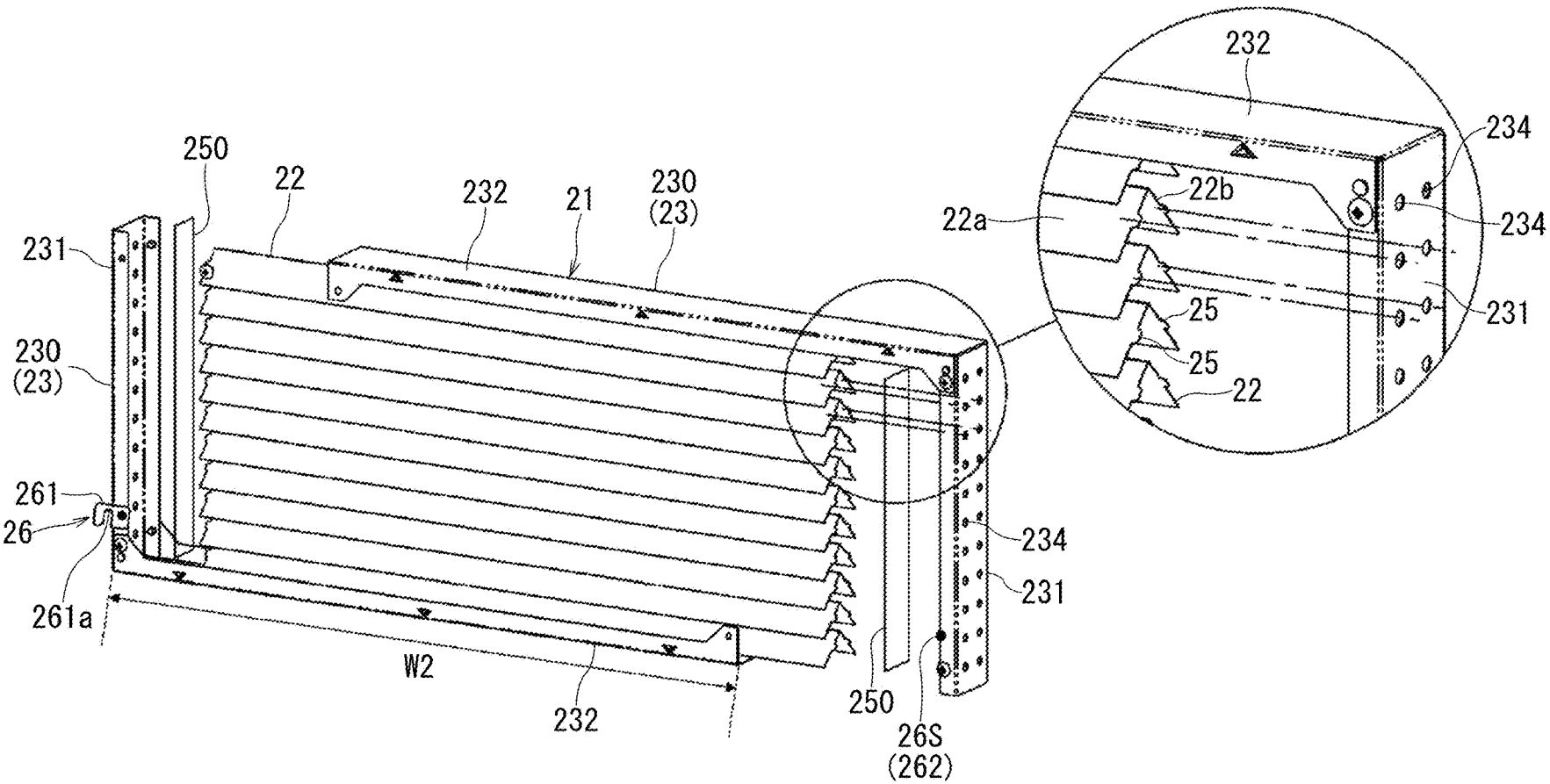
FIG. 5 is an exploded perspective view of a shading grille.

The shading grilles 21 are described with reference to FIGS. 5 and 6. FIG. 5 is an exploded perspective view of the shading grille 21, and FIG. 6 is a sectional view of the shading grille.

Figure 6:
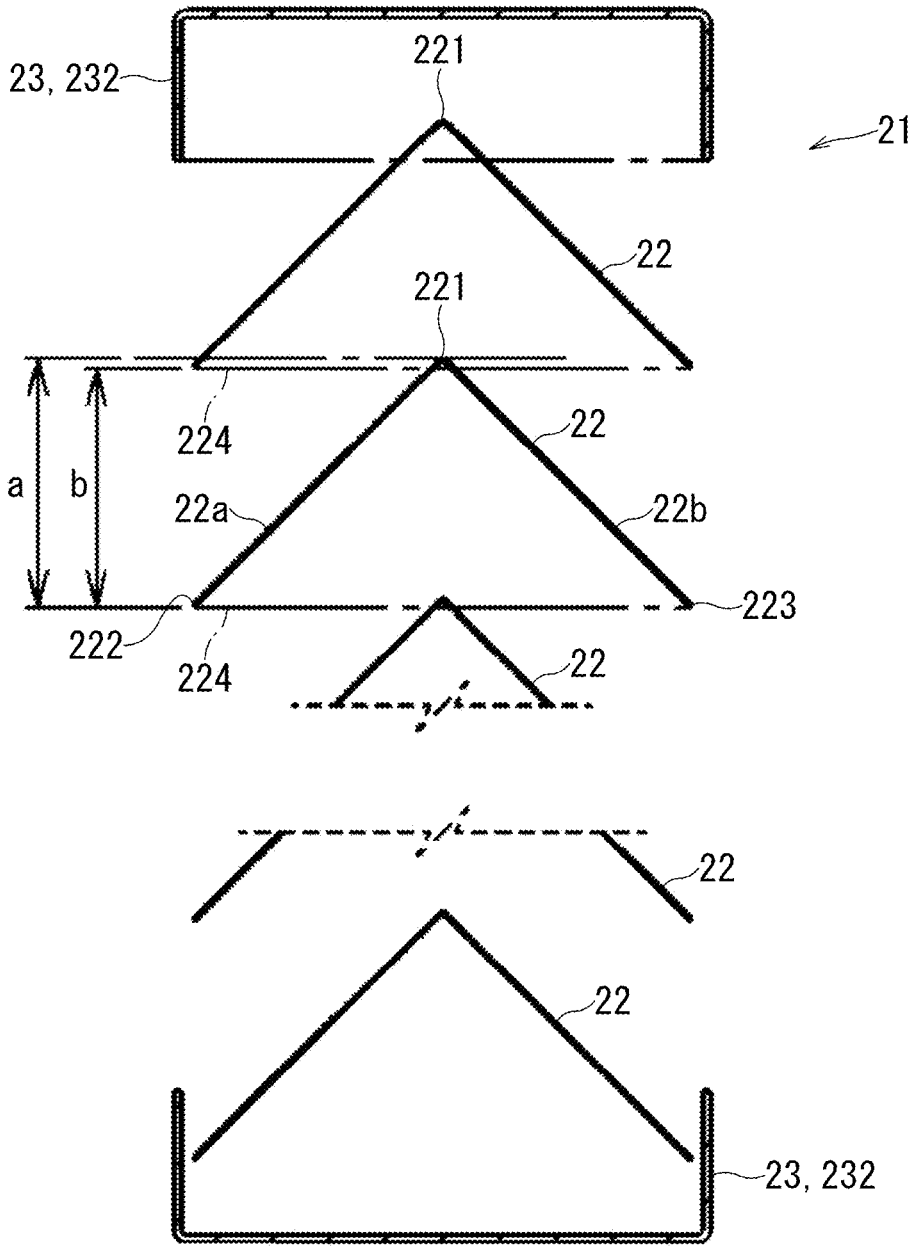
FIG. 6 is a sectional view of the shading grille.

As shown in FIGS. 5 and 6, the shading grille 21 of the sterilization unit 11 according to the present embodiment includes a plurality of inverted V-shaped louvers 22 that overlap at specified intervals, and a rectangular frame body 23 enclosing the plurality of louvers 22.

The frame body 23 includes two L-shaped members 230. The L-shaped members 230 each have a longitudinal member 231 corresponding to the short side of the shading grille 21, and a transverse member 232 corresponding to the long side of the shading grille 21. The L-shaped members 230 have a U-shaped cross section. The rectangular frame body 23 is formed by engaging both end portions of the two L-shaped members with fastening members such as screws.

A length dimension W2 of the transverse members 232 of the frame body 23, which is a longitudinal length dimension of the shading grille 21, is set to be smaller than a width dimension W3 of the maintenance hatch S3 shown by dotted lines in FIGS. 1 and 4.

The louvers 22 are molded articles each made of a thin metal sheet, such as a sheet metal. The cross-sectional shape of each of the louvers 22 is an inverted V-shaped with an approximately 90° bend. The cross-sectional shape of each of the louvers 22 is line-symmetric with respect to an apex 221. The apex 221, one lower end 222, and the other lower end 223 are connected to form a rectangular equilateral triangle. The louvers 22 each have a first plate portion 22*a* extending between the apex 221 and one lower end 222 and a second plate portion 22*b* extending between the apex 221 and the other lower end 223.

One louver 22 is disposed so as to overlap with another louver 22. The plurality of louvers 22 are disposed so that a distance "a" from a virtual line 224, which connects one lower end 222 and the other lower end 223 of each of the louvers 22, to the apex 221 of each of the louvers 22 is larger than a distance "b" that is between the virtual lines 224 of the adjacent louvers 22. This ensures that the ultraviolet light coming from the ultraviolet lamp unit 31 does not leak to the outside of the shading grille 21. It also becomes possible to prevent the leakage of ultraviolet light and to reduce loss of airflow pressure by setting the distance "a" to be larger than the distance "b" and also minimizing the difference between the distance "a" and the distance "b".

The louvers 22 each include a plurality of protrusions 25 at both end portions in the longitudinal direction. The protrusions 25 further extend from the end portions of the louver 22 in the longitudinal direction of the louver 22. One protrusion 25 is provided at each of both end portions of the first plate portion 22*a*, and one protrusion 25 is provided at each of both end portions of the second plate portion 22*b*. The protrusions 25 provided in the first plate portion 22*a* and the protrusions 25 provided in the second plate portion 22*b* are equal in distance from the apex 221.

The frame body 23 includes a plurality of engagement portions 234 corresponding to the protrusions 25. Each of the engagement portions 234 is approximately a circular hole. The plurality of engagement portions 234 are provided in the longitudinal members 231 of the frame body 23. Specifically, the plurality of engagement portions 234 are arranged in two rows in the longitudinal direction of the longitudinal members 231. In a direction orthogonal to the longitudinal direction of the longitudinal member 231, two engagement portions 234 are adjacent to each other so as to correspond to the two protrusions 25 at one end of one louver 22. In the longitudinal direction of the longitudinal member 231, the plurality of engagement portions 234 are aligned in accordance with the number of the louvers 22 so that the adjacent louvers 22 are disposed at intervals of the distance "b". When the protrusions 25 of each of the louvers 22 are inserted into the engagement portions 234, the louvers 22 are fixed to the frame body 23. With this assembly structure of the protrusions 25 and the engagement portions 234, the plurality of louvers 22 are easily retained within the frame body 23 at intervals of the constant distance "b".

Seal members 250 are provided between the louvers 22 and the longitudinal members 231 of the frame body 23. Each of the seal members 250 is disposed between two rows of the engagement portions 234. The seal members 250 reduce the noise produced by the contact between the louvers 22 and the frame body 23.

The shading grilles 21 each include a coupling mechanism 26 that couples the adjacent shading grilles 21. The coupling mechanism 26 has a coupling hook portion 261 provided in the frame body 23, and a coupling projection portion 262 provided in the frame body 23. The coupling hook portion 261 is provided in one longitudinal member 231 of the frame body 23, and the coupling projection portion 262 is provided in the other longitudinal member 231 of the frame body 23. The coupling hook portion 261 has a hook groove 261*a* that can hook the coupling projection portion 262. The hook groove 261*a* of the coupling hook portion 261 is designed to be caught by the coupling projection portion 262 of the adjacent shading grille 21. In the present embodiment, the coupling projection portion 262 is a shaft part of a screw 26S fixed to the longitudinal member 231. With the thus-configured coupling mechanism 26 in the sterilization unit 11 of the present embodiment, three shading grilles 21 are coupled in the width direction of the sterilization unit 11 as shown in FIG. 2.

Figure 8:
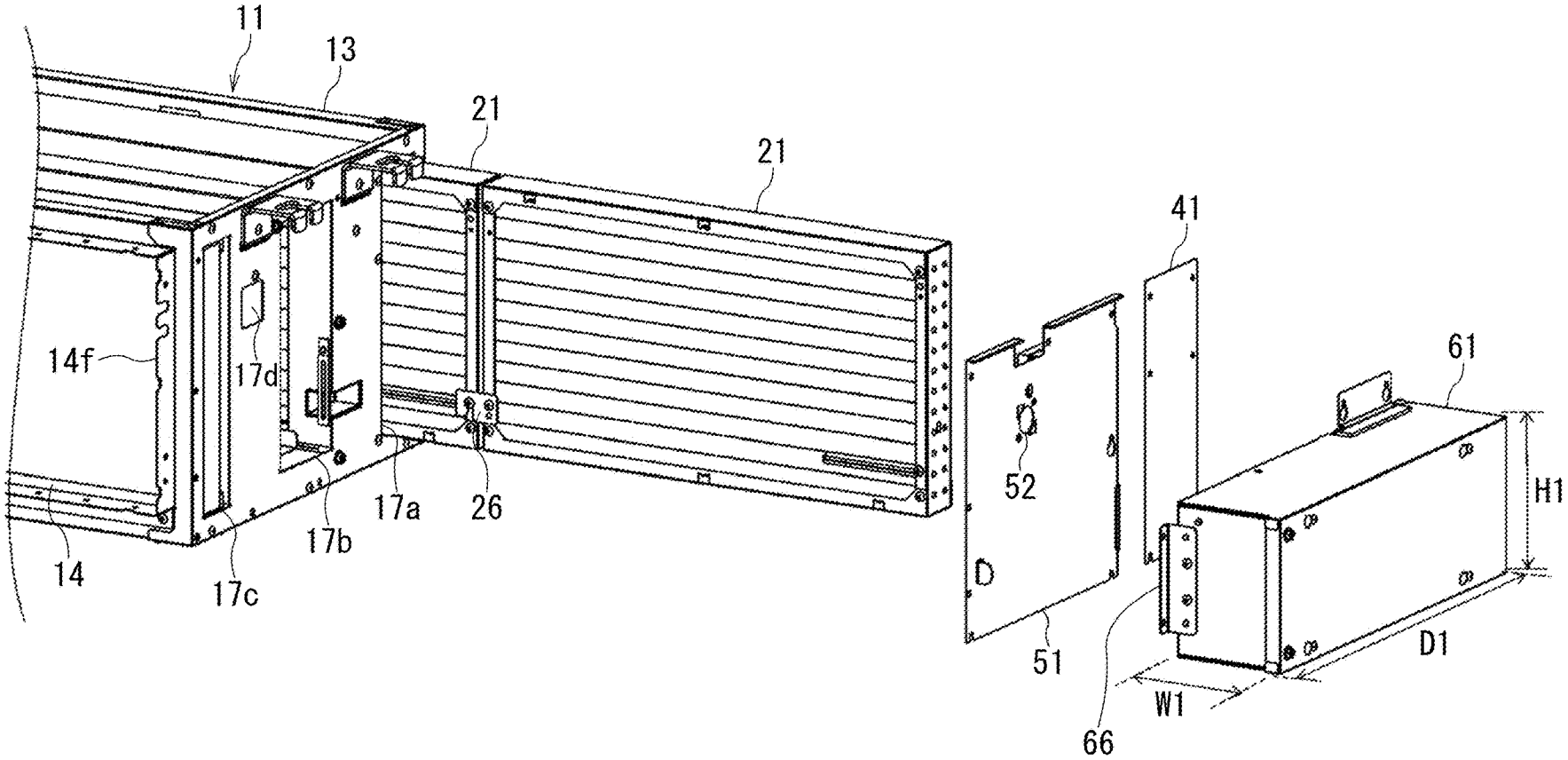
FIG. 8 is a perspective view showing maintenance panels being removed.

For maintenance and cleaning of the shading grilles 21, the shading grilles 21 can be removed one by one from the sterilization unit 11 by canceling the coupling of the coupling mechanism 26. Specifically, as shown in FIG. 8, coupling of the coupling mechanism 26 is canceled while at least one shading grille 21 is fully pulled out of the casing 12 of the sterilization unit 11. Since the dimension W2 in the longitudinal direction of the shading grilles 21 is set to be smaller than the width dimension W3 of the maintenance hatch S3, the shading grilles 21 can easily be moved in and out of the maintenance hatch S3, which improves workability.

When the plurality of shading grilles 21 are coupled and installed, small gaps may be generated between the adjacent shading grilles 21. Ultraviolet light may leak to the outside of the sterilization unit 11 through these gaps. Accordingly, as shown in FIG. 2, the casing 12 of the sterilization unit 11 includes columns 12*b* to seal the gaps between the coupling points of the shading grilles 21. The columns 12*b* can reliably prevent the leakage of ultraviolet light to the outside of the casing 12 without the need for complex structure.

Figure 7:
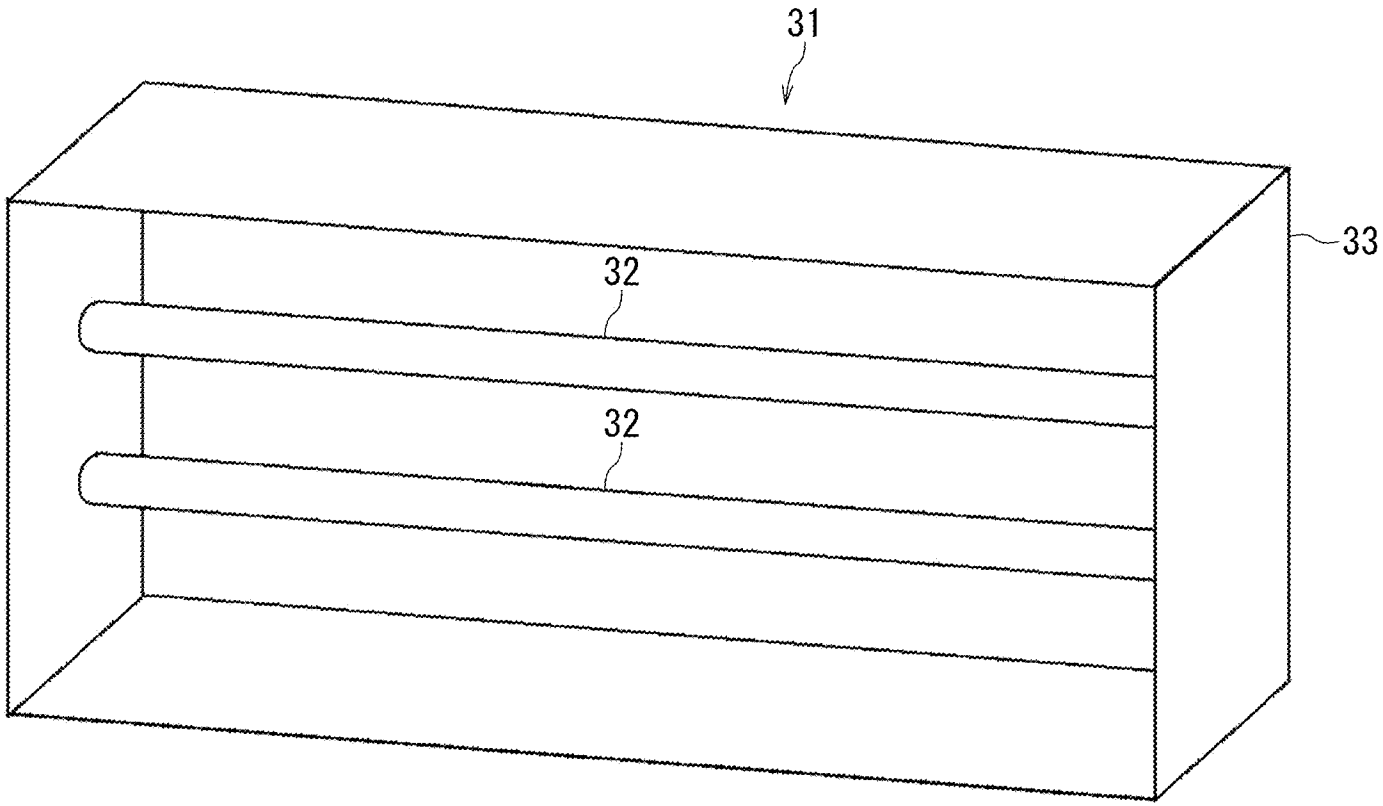
FIG. 7 is a schematic perspective view of an ultraviolet lamp unit.

The ultraviolet lamp units 31 housed in the sterilization unit 11 is described using FIG. 7. FIG. 7 is a perspective view of the ultraviolet lamp unit 31.

As shown in FIG. 7, the ultraviolet lamp unit 31 of the sterilization unit 11 according to the present embodiment includes the ultraviolet lamps 32 and a frame body 33 that fixes the ultraviolet lamps 32. The ultraviolet lamps 32 emit ultraviolet light of 100 nanometers (nm) to 280 nanometers (nm), which is classified as UV-C. The plurality of ultraviolet lamps 32, that is, two ultraviolet lamps 32, for example, are attached to the frame body so as to be aligned at upper and lower sides in the thickness (height) direction of the sterilization unit 11 and to extend horizontally in the width direction of the sterilization unit 11.

The frame body 33 of the ultraviolet lamp unit 31 includes a coupling mechanism (not shown). When two ultraviolet lamp units 31 are housed in the casing 12, the adjacent ultraviolet lamp units 31 are electrically connected. It is desirable that the length dimension of the ultraviolet lamp units 31 in the longitudinal direction is set to be smaller than the width dimension W3 of the maintenance hatch S3, as in the case of the shading grilles 21.

The casing 12 includes a first maintenance panel 41 and a second maintenance panel 51 for attaching and detaching the shading grilles 21 or the ultraviolet lamp units 31 to and from the sterilization unit 11. The first maintenance panel 41 and the second maintenance panel 51 are attached to the first side plate 17 of the casing 12.

FIG. 8 is a perspective view showing the first maintenance panel 41 and the second maintenance panel 51 being removed from the sterilization unit 11. The first maintenance panel 41 and the second maintenance panel 51 are described using FIGS. 2, 4 and 8.

As shown in FIG. 8, the first side plate 17 of the casing 12 of the sterilization unit 11 according to the present embodiment has an access hole 17*a* for the shading grilles 21 on the side of the suction port 13, an access hole 17*b* for the ultraviolet lamp units 31, and an access hole 17*c* for the shading grilles 21 on the side of the blowout port 14.

The first side plate 17 of the casing 12 further has an inspection hole 17*d* disposed between the access hole 17*b* for the ultraviolet lamp units 31 and the access hole 17*c* for the shading grilles 21 on the side of the blowout port 14.

As shown in FIG. 4, the casing 12 includes guide rails 19*a*, 19*b*, and 19*c* that guide the shading grilles 21 and the ultraviolet lamp units 31 to prescribed positions. The guide rails 19*a*, 19*b*, and 19*c* correspond to the access holes 17*a*, 17*b*, and 17*c* on the first side plate 17, respectively. The guide rails 19*a*, 19*b*, and 19*c* guide the shading grilles 21 and the ultraviolet lamp units 31 to prescribed positions inside the casing 12. The guide rails 19*a*, 19*b*, and 19*c* extend along the width of the casing 12 from the vicinity of the first side plate 17. Each of the guide rails 19*a*, 19*b*, and 19*c* is a pair of facing rails provided on the top plate 15 and the bottom plate 16 of the casing 12. The guide rails 19*a* and 19*c* correspond to the shading grilles 21, while the guide rail 19*b* corresponds to the ultraviolet lamp units 31.

As shown in FIG. 8, when the first maintenance panel 41 is removed, the access hole 17*a* for the shading grilles 21 on the side of the suction port 13 is exposed. When the second maintenance panel 51 is removed, the access hole 17*b* for the ultraviolet lamp units 31, the access hole 17*c* for the shading grilles 21 on the side of the blowout port 14, and the inspection hole 17*d* are exposed.

The second maintenance panel 51 includes an inspection window 52 that allows visual inspection of the inside of the sterilization unit 11 through the inspection hole 17*d*, and a piece portion 73 that is part of a detection mechanism 71 described later.

Figure 9:
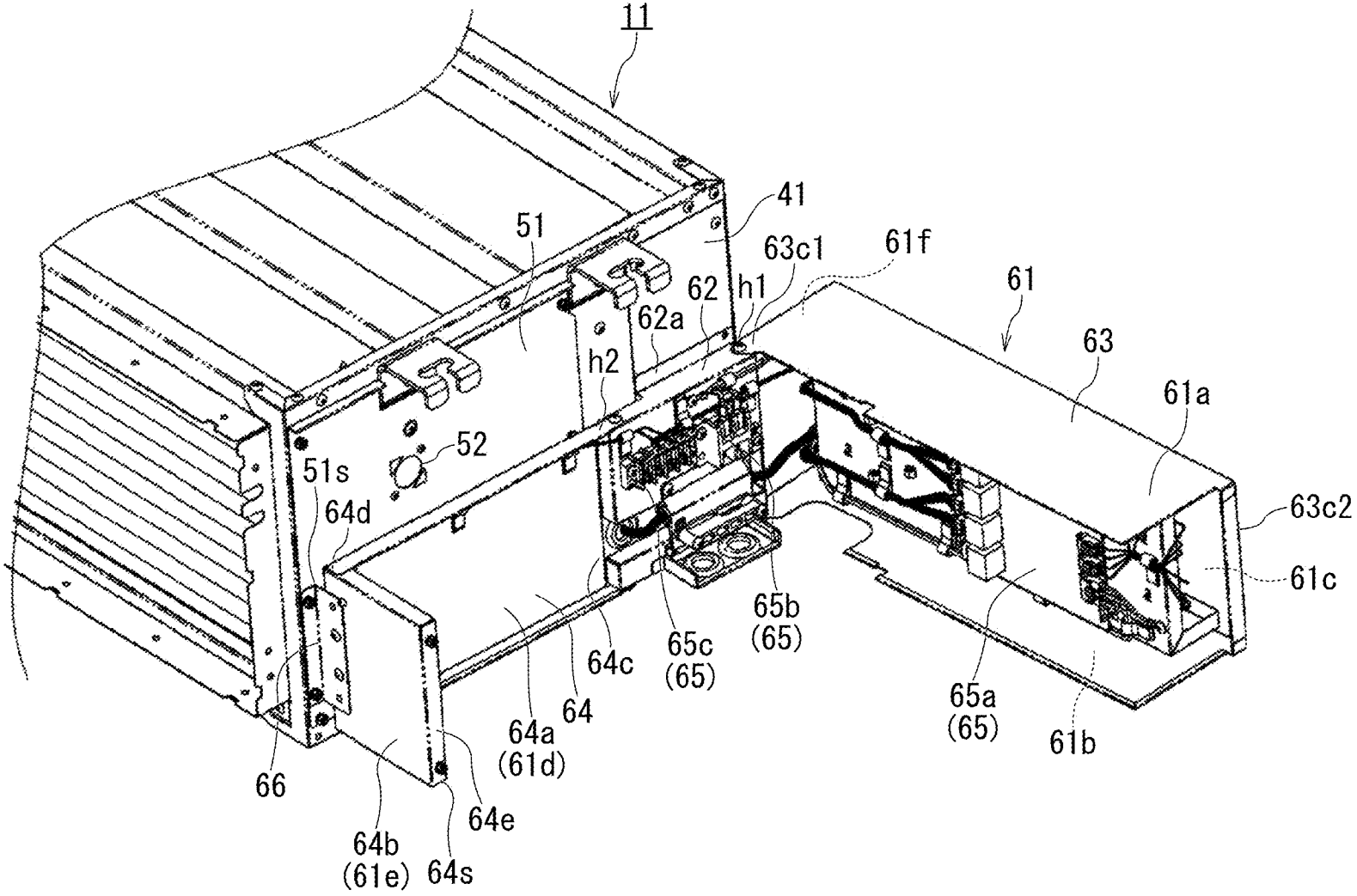
FIG. 9 is a perspective view showing a first lid part of an electric component box being rotated.
Figure 10:
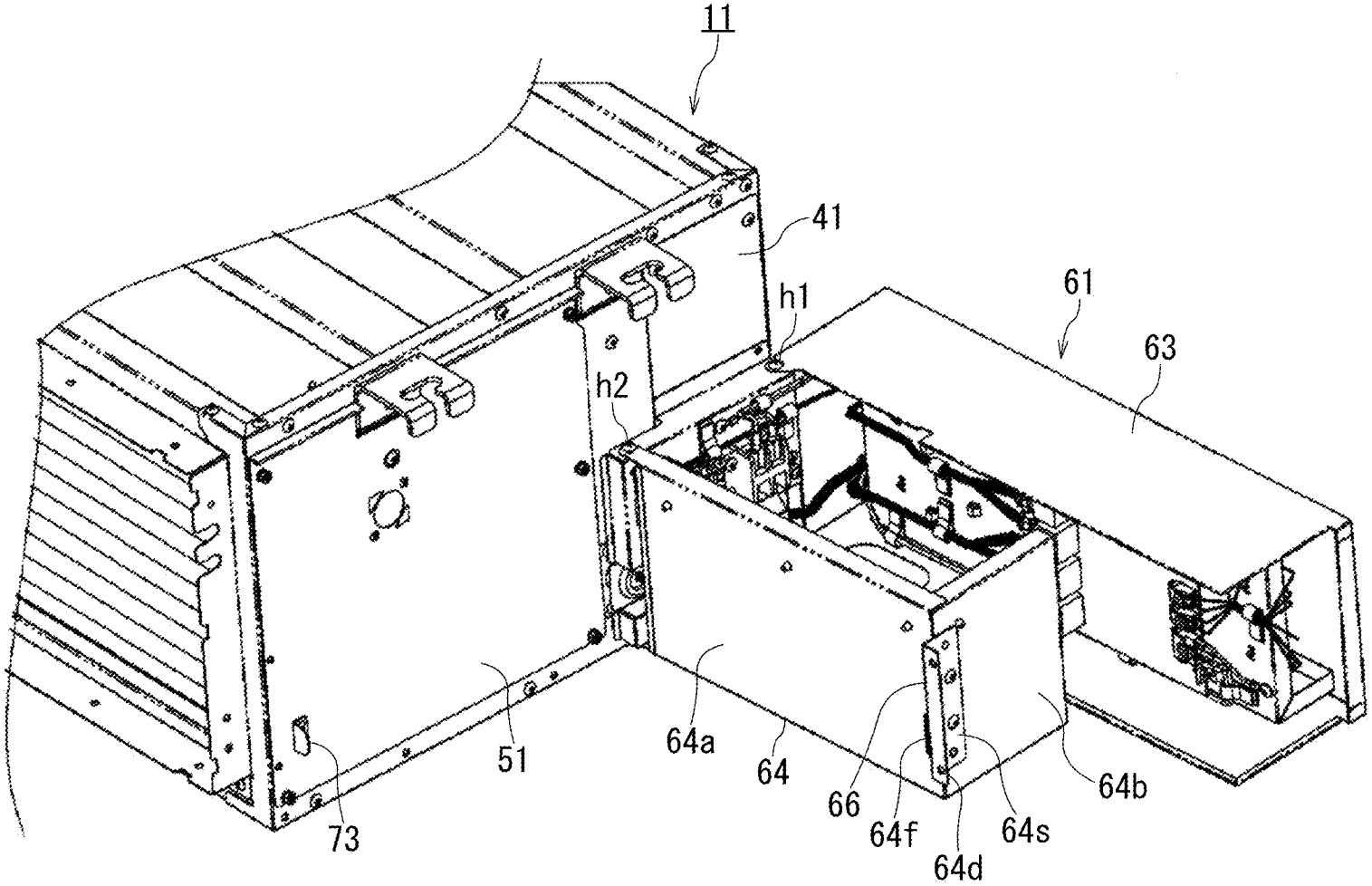
FIG. 10 is a perspective view showing a second lid part of the electric component box being rotated.
Figure 11:
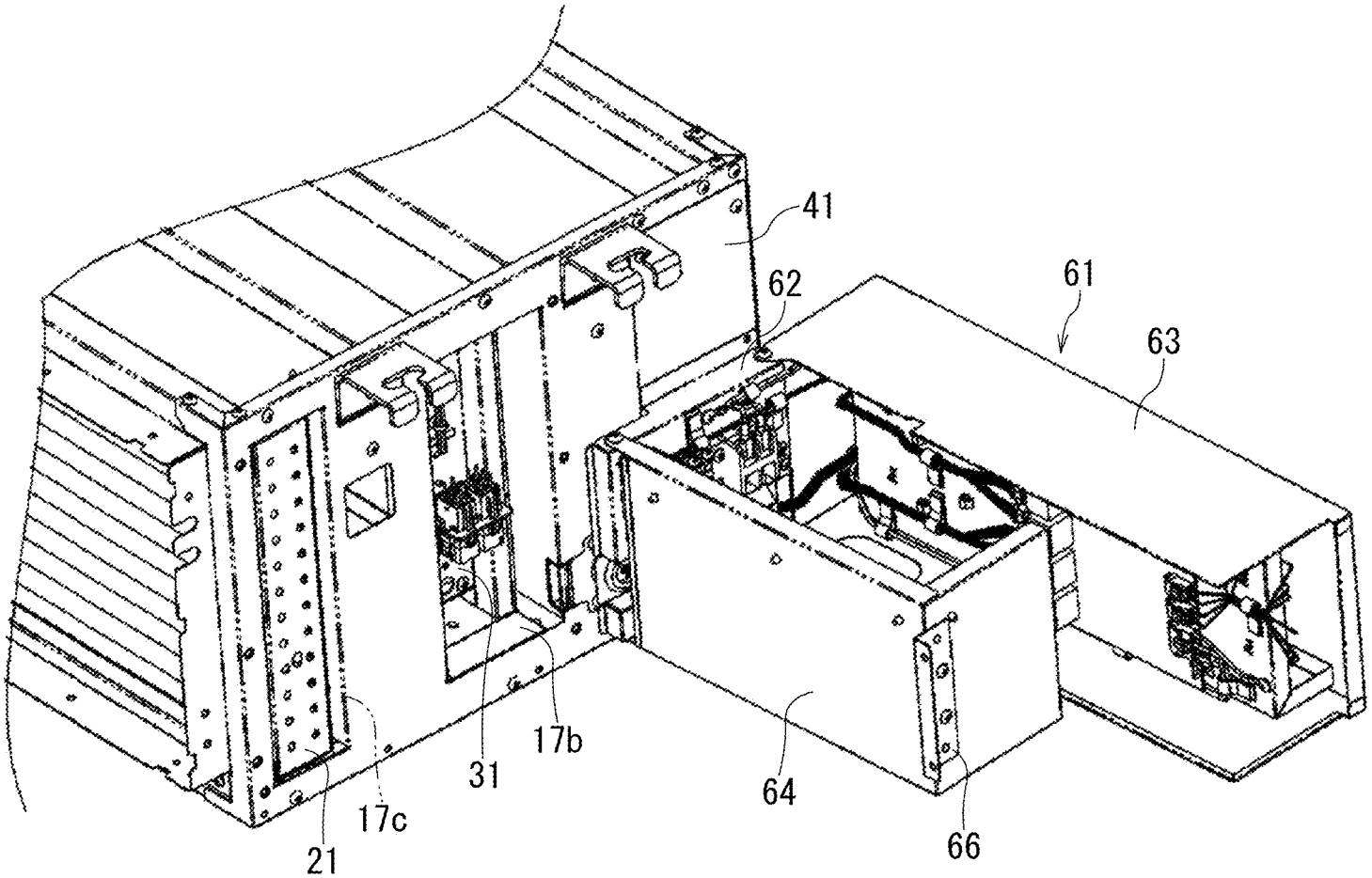
FIG. 11 is a perspective view showing a second maintenance panel being removed in the state of FIG. 10.
Figure 12:
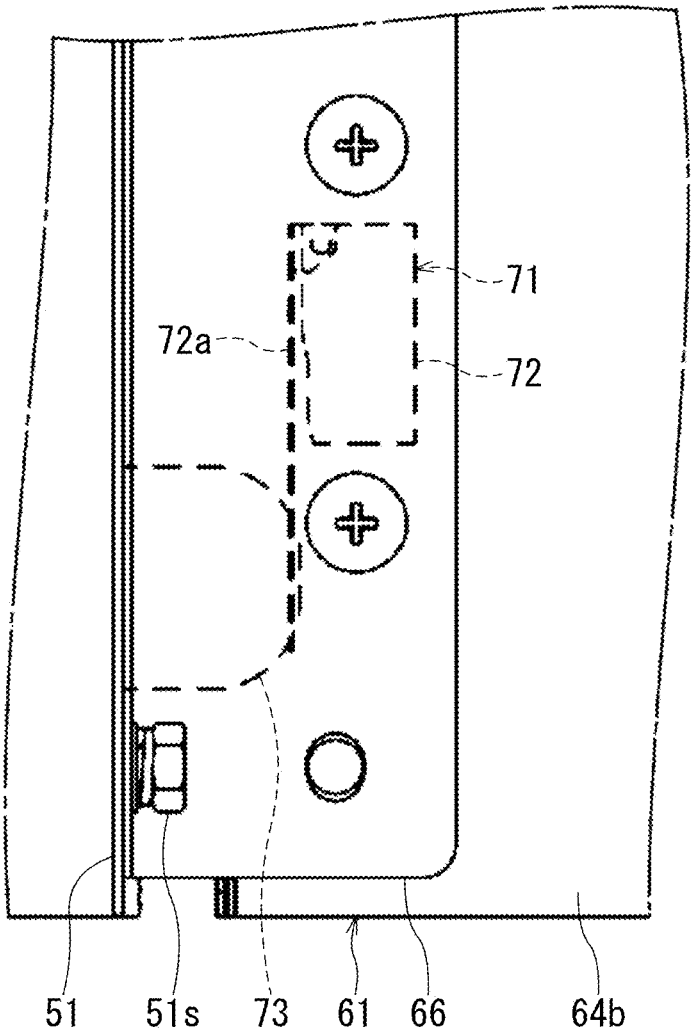
FIG. 12 is a schematic diagram showing a detection mechanism.

FIG. 9 is a perspective view showing a first lid part being rotated in the state of FIG. 2. FIG. 10 is a perspective view showing a second lid part being rotated in the state of FIG. 9. FIG. 11 is a perspective view showing the second maintenance panel being removed in the state of FIG. 10. FIG. 12 is a schematic diagram showing the detection mechanism. The electric component box 61 is described using FIGS. 2 to 4 and 9 to 12.

As shown in FIGS. 2 to 4, the electric component box 61 of the sterilization unit 11 according to the present embodiment is provided outside the first maintenance panel 41 and the second maintenance panel 51.

The electric component box 61 has a rectangular parallelepiped shape that is narrower and longer than the casing 12. The electric component box 61 has a depth dimension D1, a width dimension W1, and a thickness dimension H1. The depth dimension D1 of the electric component box 61 is substantially the same as the depth dimension D of the casing 12. The thickness dimension H1 of the electric component box 61 is about half the thickness dimension H of the casing 12. The width dimension W1 of the electric component box 61 is smaller than the width dimension W of the casing 12.

As shown in FIGS. 9 to 11, the electric component box 61 includes a base part 62, a first lid part 63, and a second lid part 64. The base part 62, the first lid part 63, and the second lid part 64 are molded articles made of metal sheets, such as sheet metals. The base part 62, the first lid part 63, and the second lid part 64 define the rectangular parallelepiped outline of the electric component box 61. Specifically, the base part 62 defines an inner side surface portion 61*d* of the electric component box 61 together with the second lid part 64. The first lid part 63 defines an upper surface portion 61*a*, a lower surface portion 61*b*, an outer side surface portion 61*c*, and a rear surface portion 61*f* of the electric component box 61. The second lid part 64 defines a front surface portion 61*e* and part of the inner side surface portion 61*d* of the electric component box 61.

The base part 62 includes a fixed portion 62*a* that is fixed to the first maintenance panel 41 with a fastening member, such as a screw. In addition, the electric component 65, including a power terminal block 65*b* and an external control terminal block 65*c* that is connected to a communication line leading to the air conditioning indoor unit 1, is attached to the base part 62 inside the electric component box 61.

The base part 62 includes a first hinge portion h1 and a second hinge portion h2. The first hinge portion h1 swingably couples the first lid part 63 to the base part 62. The second hinge portion h2 swingably couples the second lid part 64 to the base part 62.

The first lid part 63 has a first corner portion 63*c*1 of the casing 12 of the sterilization unit 11 on the side of the suction port 13, and a second corner portion 63*c*2 that is positioned on a diagonal line of the first corner portion 63*c*1. The first corner portion 63*c*1 is rotatably attached to the first hinge portion h1 of the base part 62. The second corner portion 63*c*2 is fixed to an end portion 64*e* of a second surface portion 64*b* of the second lid part 64 with a screw 64*s*.

The control board 65*a* that controls lighting of the ultraviolet lamp units 31 is attached on the first lid part 63 inside the electric component box 61. When the first lid part 63 is moved to the position shown in FIG. 9, the electric component box 61 is opened and the inside of the electric component box 61 becomes visible. Specifically, the first lid part 63, which covers most of the electric component box 61, horizontally rotates approximately 90° around the first hinge portion h1. With the movement of the first lid 63, the power terminal block 65*b* and the external control terminal block 65*c* in the base part 62 that are covered with the first lid part 63, and the control board 65*a* attached to the first lid part 63 are exposed.

In the state where only the first lid part 63 is opened as shown in FIG. 9, it is possible to inspect the electric component 65, including the control board 65*a*, while continuing an operating state of the electric component 65 and checking the state of the ultraviolet lamp units 31 through the inspection window 52 of the second maintenance panel 51.

As shown in FIG. 10, the second lid part 64 is L-shaped. The second lid part 64 has a first surface portion 64*a* facing the second maintenance panel 51, and the second surface portion 64*b* that constitutes the front surface portion 61*e* of the electric component box 61. One end portion 64*c* of the first surface portion 64*a* is rotatably attached to the second hinge portion h2 of the base part 62. The other end portion 64*d* of the first surface portion 64*a* continues to the second surface portion 64*b* at a right angle. The first lid part is fixed to the end portion 64*e* of the second surface portion 64*b* is fixed to 63 with a screw 64*s*.

The second lid part 64 includes a bracket 66 that is attached to a region of the second surface portion 64*b* on the side of the blowout port 14 of the casing 12 of the sterilization unit 11 and that is fixed to the second maintenance panel 51 with a screw 51*s*.

When the second lid part 64 is moved to the position shown in FIG. 11, the second maintenance panel 51 is ready to be removed. Specifically, the second lid part 64 that blocks the second maintenance panel 51 horizontally rotates approximately 90° around the second hinge portion h2. With the movement of the second lid part 64, the second maintenance panel 51 that is covered with the second lid part 64 is exposed. The second maintenance panel 51 is attached to the casing 12 of the sterilization unit 11 with the screw 51*s*, and the second maintenance panel 51 can be removed from the casing 12 by unscrewing the screw 51*s*.

Next, the detection mechanism 71 that detects opening and closing of the second lid part 64 is described using FIGS. 10 to 12.

The detection mechanism 71 of the sterilization unit 11 according to the present embodiment includes, as main elements, a microswitch 72 serving as a detection unit and a piece portion 73 serving as a detection target.

As shown in FIG. 12, the microswitch 72 that is the detection unit is attached at a position on the second surface portion 64*b* inside the electric component box 61, the position corresponding to the rear side of the bracket 66. The microswitch 72 is a switch unit that supplies and stops power to the electric component 65. The microswitch 72 has a lever 72*a* that supplies power to the electric component 65 when being pressed and that returns to a return position and stops power supply when pressing force is lost. The second maintenance panel 51 includes the piece portion 73 that presses the lever 72*a* of the microswitch 72. The first surface portion 64*a* of the second lid part 64 has a slit 64*f* disposed in the vicinity of the bracket 66 to allow the piece portion 73 to pass through.

As shown in FIG. 10, while the second lid part 64 is closed, and specifically, while the second lid part 64 blocks the second maintenance panel 51, i.e., while the second lid part 64 is in a prescribed position, the piece portion 73 is inserted into the electric component box 61 through the slit 64*f* and presses the lever 72*a* of the microswitch 72. When the lever 72*a* is pressed, the microswitch 72 is put in an ON state, so that power is supplied to the electric component 65 including the control board 65*a*.

On the other hand, as shown in FIG. 11, while the second lid part 64 is opened, and specifically, while the second lid part 64 does not block the second maintenance panel 51, i.e., while the second lid part 64 is not in the prescribed position, the piece portion 73 is released through the slit 64*f* and is separated from the lever 72*a* of the microswitch 72. When the force to press the lever 72*a* is released, the microswitch 72 is put in an OFF state, so that power supply to the electric component 65 including the control board 65*a* is stopped.

During the inspecting work and the replacing work of the ultraviolet lamp units 31, it is necessary to move the second lid part 64 to the position shown in FIG. 10 and then remove the second maintenance panel 51 to put the access hole 17*b* for the ultraviolet lamp units 31 in an open state as shown in FIG. 11. In the state shown in FIG. 10, the detection mechanism 71 has already stopped power supply to the control board 65*a* and therefore the ultraviolet lamps 32 are turned off. This ensures that the ultraviolet lamps 32 are turned off when the second maintenance panel 51 is removed. Therefore, there is no risk that an operator directly looks at ultraviolet light.

Even if the second lid part 64 should be closed without attaching the second maintenance panel 51 at the end of the inspecting work and the replacing work of the ultraviolet lamp units 31, the detection mechanism 71 maintains the OFF state that is the state where power supply is stopped, so that the ultraviolet lamps 32 are not lit. This ensures the safety of the operator.

Although some of the embodiments of the present invention have been described in the foregoing, the embodiments are merely illustrative and are not intended to restrict the scope of the invention. These new embodiments can be performed in other various forms, and various kinds of omissions, replacements and modifications are possible without departing from the meaning of the invention. These embodiments and their changes are not only embraced in the range and scope of the invention but are also embraced in the invention set forth in the claims and in the range of the equivalency thereof.

For example, in the present embodiment, the sterilization unit 11 is directly connected to the duct-type air conditioning indoor unit 1, though the air conditioning indoor unit 1 and the sterilization unit 11 may be connected indirectly. For example, a relay duct may be provided between the air conditioning indoor unit 1 and the sterilization unit 11. In place of the duct-type air conditioning indoor unit 1, an outside air processing indoor unit that incorporates a total heat exchanger may be connected to the sterilization unit.

Moreover, the sterilization unit 11 may include a high-performance filter in place of the shading grilles 21 disposed on the side of the blowout port 14. In this case, the high-performance filter captures remaining germs that have passed through the ultraviolet lamp units 31, and the ultraviolet lamps 32 can irradiate the high-performance filter with ultraviolet light to eliminate the germs captured by the high-performance filter. As a result, the sterilization performance of the sterilization unit 11 is further enhanced.

Furthermore, the detection mechanism 71 may include an optical sensor or a magnetic sensor capable of detecting whether the second lid part 64 blocks the second maintenance panel 51, in place of the microswitch 72 and the piece portion 73.

REFERENCE SIGNS LIST

1 . . . indoor unit, 2 . . . casing, 3 . . . blower, 4 . . . heat exchanger, 5 . . . drain pan, 6 . . . suction port, 7 . . . blowout port, 11 . . . sterilization unit, 12 . . . casing, 12*a* . . . hanging metal fitting, 12*b* . . . column, 13 . . . suction port, 14 . . . blowout port, 14*f* . . . connection flange, 15 . . . top plate, 16 . . . bottom plate, 17 . . . first side plate, 17*a* . . . access hole, 17*b* . . . access hole, 17*c* . . . access hole, 17*d* . . . inspection hole, 18 . . . second side plate, 19*a* . . . guide rail, 19*b* . . . guide rail, 19*c* . . . guide rail, 21 . . . shading grille, 22 . . . louver, 22*a* . . . first plate portion, 22*b* . . . second plate portion, 221 . . . apex, 222, 223 . . . lower end, 224 . . . virtual line, 23 . . . frame body, 230 . . . L-shaped member, 231 . . . longitudinal member, 232 . . . transverse member, 234 . . . engagement portions, 25 . . . protrusion, 250 . . . seal member, 26 . . . coupling mechanism, 261 . . . coupling hook portion, 261*a* . . . hook groove, 262 . . . coupling projection portion, 31 . . . ultraviolet lamp unit, 32 . . . ultraviolet lamps, 33 . . . frame body, 41 . . . first maintenance panel, 51 . . . second maintenance panel, 51*s* . . . screw, 52 . . . inspection window, box 61 . . . electric component, 61*a* . . . upper surface portion, 61*b* . . . lower surface portion, 61*c* . . . outer side surface portion, 61*d* . . . inner side surface portion, 61*e* . . . front surface portion, 61*f* . . . rear surface portion, 62 . . . base part, 62*a* . . . fixed portion, 63 . . . first lid part, 63*c*1 . . . first corner portion, 63*c*2 . . . second corner portion, 64 . . . second lid part, 64*a* . . . first surface portion, 64*b* . . . second surface portion, 64*c*, 64*e* . . . end 64*d*, portion, 64*f* . . . slit, 64*s* . . . screw, 65 . . . electric component, 65*a* . . . control board, 65*b* . . . power terminal block, 65*c* . . . external control terminal block, 66 . . . bracket, 71 . . . detection mechanism, 72 . . . microswitch, 72*a* . . . lever, 73 . . . piece portion, S1 . . . indoor air suction port, S2 . . . air-conditioned air blowout port, S3 . . . maintenance hatch, P1 . . . suction duct, P2 . . . blowout duct, h1 . . . first hinge portion, h2 . . . second hinge portion.

The invention claimed is:

1. A sterilization unit, comprising:

a casing;

an ultraviolet lamp configured to sterilize air passing through the casing;

a control board configured to control the ultraviolet lamp; and an electric component box provided on one side surface of the casing and configured to house the control board, wherein the electric component box includes:

a base part fixed to the casing, a first lid part that is swingably coupled to the base part, a second lid part that is swingably coupled to the base part, and a detector configured to detect that the second lid part is not in a prescribed position, and the control board is attached to the first lid part.

2. The sterilization unit according to claim 1, wherein the casing includes a maintenance panel configured to be selectively opened when the ultraviolet lamp is inspected or replaced and closed; and the maintenance panel includes a detection target configured to be detected by the detector.

* * * * *